US010413777B2

(12) United States Patent
Hsieh

(10) Patent No.: US 10,413,777 B2
(45) Date of Patent: Sep. 17, 2019

(54) XBIKE DESK AND EXERCISE SEMI-RECUMBENT BICYCLE

(71) Applicant: Paul Hsieh, City of Industry, CA (US)

(72) Inventor: Paul Hsieh, City of Industry, CA (US)

(73) Assignee: Paradigm Health and Wellness, City of Industry, CA (US)

( * ) Notice: Subject to any disclaimer, the term of this patent is extended or adjusted under 35 U.S.C. 154(b) by 19 days.

(21) Appl. No.: 15/456,486

(22) Filed: Mar. 11, 2017

(65) Prior Publication Data

US 2017/0259111 A1 Sep. 14, 2017

Related U.S. Application Data

(60) Provisional application No. 62/307,736, filed on Mar. 14, 2016.

(51) Int. Cl.
*A63B 22/06* (2006.01)
*A63B 71/06* (2006.01)
(Continued)

(52) U.S. Cl.
CPC ..... *A63B 22/0605* (2013.01); *A47B 83/02* (2013.01); *A63B 71/0622* (2013.01);
(Continued)

(58) Field of Classification Search
CPC ..... A47B 3/002; A47B 9/20; A47B 13/081; A47B 13/16; A47B 21/02; A47B 21/04; A47B 21/06; A47B 23/06; A47B 83/02; A47B 2021/066; A47B 2083/025; A63B 21/00069; A63B 21/0052; A63B 21/0053; A63B 21/0088; A63B 21/012; A63B 21/4034; A63B 21/4035; A63B 22/0015; A63B 22/0605; A63B 22/0622;
(Continued)

(56) References Cited

U.S. PATENT DOCUMENTS

| | | | | |
|---|---|---|---|---|
| D233,160 | S * | 10/1974 | Jouk | D21/663 |
| 5,177,665 | A | 1/1993 | Frank | |
| D407,767 | S * | 4/1999 | Chang | D21/663 |
| 6,033,344 | A * | 3/2000 | Trulaske | A61B 5/0002 482/54 |
| 6,702,719 | B1 | 3/2004 | Brown | |
| 7,335,147 | B2 * | 2/2008 | Jones | A63B 71/0622 433/25 |

(Continued)

OTHER PUBLICATIONS

A Split-Crank Bicycle Ergometer Uses Servomotors to Provide Programmable Pedal Force for Studies in Human Biomechanics; Van der Loos; Aug. 4, 2010 (Year: 2010).*

*Primary Examiner* — Megan Anderson
(74) *Attorney, Agent, or Firm* — Kirk A. Buhler; Buhler & Associates Patenting

(57) ABSTRACT

Improvements to a desk and exercise semi-recumbent bicycle is disclosed, the desk allows a person exercising while utilizing the desk with a computer, as a table or read a book. The desk has a 3-way adjustment relative to the seat for elevation of the desk, angle, sliding forward and backward of the desk or the proximity of the desk relative to the chair and or the pedals. The desk pivots to allow the desk to be easily tilted towards the user when they are studying and tilted away from the user when the user wants to exit the exercise bicycle. The dimension from the seat to the pedals is adjustable to accommodate these different desires. The amount of resistance can be adjusted to increase or decrease the difficulty to accommodate different levels of activity. A recording mechanism can count distance, elapsed time, calories or other information.

20 Claims, 3 Drawing Sheets

(51) Int. Cl.

| | |
|---|---|
| ***A47B 83/02*** | (2006.01) |
| *A63B 21/005* | (2006.01) |
| *A63B 21/008* | (2006.01) |
| *A63B 21/012* | (2006.01) |
| *A47B 21/02* | (2006.01) |
| *A47B 21/04* | (2006.01) |
| *A47B 21/06* | (2006.01) |

(52) U.S. Cl.

CPC ..... *A47B 21/02* (2013.01); *A47B 21/04* (2013.01); *A47B 2021/066* (2013.01); *A47B 2083/025* (2013.01); *A63B 21/0051* (2013.01); *A63B 21/0052* (2013.01); *A63B 21/0053* (2013.01); *A63B 21/0088* (2013.01); *A63B 21/012* (2013.01); *A63B 2022/0635* (2013.01); *A63B 2022/0652* (2013.01); *A63B 2071/0625* (2013.01); *A63B 2210/50* (2013.01); *A63B 2220/20* (2013.01); *A63B 2220/30* (2013.01); *A63B 2220/807* (2013.01); *A63B 2225/09* (2013.01); *A63B 2225/50* (2013.01); *A63B 2225/682* (2013.01); *A63B 2225/685* (2013.01); *A63B 2230/06* (2013.01); *A63B 2230/75* (2013.01)

(58) Field of Classification Search

CPC ..... A63B 2022/0652; A63B 2210/50; A63B 2220/20; A63B 2220/30; A63B 2220/62; A63B 2230/06; A63B 2230/75

See application file for complete search history.

(56) References Cited

U.S. PATENT DOCUMENTS

| | | | | |
|---|---|---|---|---|
| 7,422,548 | B1 * | 9/2008 | Teng | A63B 21/0051 482/51 |
| 7,510,509 | B2 * | 3/2009 | Hickman | A63B 22/0605 482/1 |
| 7,775,942 | B2 * | 8/2010 | Hildebrandt | A63B 21/154 482/52 |
| 8,490,846 | B1 | 7/2013 | Wheatley | |
| 8,734,302 | B2 * | 5/2014 | Hsieh | A63B 22/02 482/54 |
| 9,468,794 | B2 * | 10/2016 | Barton | A63B 71/0622 |
| 9,750,343 | B2 * | 9/2017 | McBride | A47B 83/02 |
| D807,443 | S * | 1/2018 | Hsieh | D21/667 |
| 2003/0008752 | A1 | 1/2003 | Hsu | |
| 2003/0064866 | A1 | 4/2003 | Chen | |
| 2010/0206124 | A1 | 8/2010 | Ferrusi | |
| 2011/0086707 | A1 | 4/2011 | Loveland | |
| 2011/0165997 | A1 | 7/2011 | Reich | |
| 2012/0322625 | A1 * | 12/2012 | Park | A63B 22/0012 482/62 |
| 2014/0037867 | A1 | 2/2014 | Wheatley | |
| 2014/0038781 | A1 | 2/2014 | Foley | |
| 2014/0073489 | A1 * | 3/2014 | Wu | A63B 22/0605 482/57 |
| 2015/0335936 | A1 * | 11/2015 | Shakespeare | A63B 21/0084 482/58 |

* cited by examiner

XBIKE DESK AND EXERCISE SEMI-RECUMBENT BICYCLE

CROSS REFERENCE TO RELATED APPLICATIONS

This application claims the benefit of Provisional Application Ser. No. 62/307,736 filed Mar. 14, 2016 the entire contents of which is hereby expressly incorporated by reference herein.

BACKGROUND OF THE INVENTION

Field of the Invention

This invention relates to improvements in an exercise bicycle. More particularly, the present exercise bicycle is a semi-recumbent style exercise bicycle with a desk that allows a person to comfortably stand between the seat, desk and pedals.

Description of Related Art Including Information Disclosed under 37 CFR 1.97 and 1.98

Many people have a desire to exercise but have limited time to exercise as they have additional responsibilities and activities that occupy their time. This is especially true for students of that spend large amounts of sedentary time reading, studying and other activities where they typically are in a seated or in a semi-recumbent position. One problem with exercise bicycles is that a person must contort their body as they lift their feet and legs off pedals, and bend around the display of an exercise bicycle.

There have been some patents for exercise bicycles that focus on the exercise and they are generally constructed to allow a person to read a book or watch TV while they exercise. A number of patents and or publications have been made to address these issues. Exemplary examples of patents and or publication that try to address this/these problem(s) are identified and discussed below.

U.S. Pat. No. 5,177,665 issued on Jan. 5, 1993 to Michael J. Frank et al., discloses a housing and vehicular support for portable computer with a mounting assembly for a small portable computer provides both a housing to receive the computer and releasably attach it to a vehicle steering wheel and connections for supplying electrical power to the computer. While this patent supplies a mounting for a computer, the patent is for a vehicle steering wheel and not for a piece of exercise equipment.

U.S. published application 2003/0008752 was published on Jan. 9, 2003 for Hank Hsu discloses a structure of stationary bicycle. The stationary bicycle includes a machine base, a seat on the machine base for the sitting of the user, a back cushion mounted on the machine base and adapted to support the back of the user sitting on the seat, a pedal and damper unit installed in the machine base and adapted to impart a damping power against the external force employed by the user. This is a full recumbent bicycle and the structure restricts a person from standing between the seat pedals and desk.

U.S. published application 2010/0206124 was published on Aug. 19, 2010 for Steve J. Ferrusi discloses a handlebar armrest. The armrest is for use on bicycle type handlebars of stationary bikes and bicycles used as indoor trainers. The device allows operator to rest forearms on padded and absorbent top surface for increased comfort and free use of hands and fingers while exercising. The person exercising can lean forward to use the computer while they exercise. This is a mounting for an actual bicycle and the pedals are located in the area where a person will stand.

What is needed is an exercise bicycle configured in a semi-recumbent position with a movable desk that allows a person to exercise, work and easily stand. The proposed Xbike desk and exercise semi-recumbent bicycle provides the solution.

BRIEF SUMMARY OF THE INVENTION

It is an object of the Xbike desk and exercise semi-recumbent bicycle to provide an exercise bicycle that has a desk to allow a person exercising to comfortably utilize the desk to use a computer, tablet, cell phone, draw, use a table or read a book. The desk is adjustable relative to the seat to configure at least one of the elevation of the desk, angle of the desk or the proximity of the desk relative to the chair and or the pedals. The desk can also be pivotable to allow the desk to be easily tilted towards the user when they are studying and tilted away from the user when the user wants to exit the exercise bicycle without climbing over the pedals. The position of the pedals allows a person the easily stand to use the desk without the obstruction of the pedals.

It is an object of the Xbike desk and exercise semi-recumbent bicycle for the seat to be adjusted relative to the pedals. All people have different length from where they pedal to their preferred seated position. Some people prefer to sit on the edge of a seat while others may prefer to sit back in a seat. Their preferred position can also be effected by the type of reading, studying, working or playing they be use while they exercise. The dimension from the seat to the pedals is adjustable to accommodate these different desires. Further, a semi-recumbent bicycle provides hybrid between a racing style bicycle where a user leans forward and a recumbent bicycle where the person exercising is essentially seated horizontally.

It is another object of the Xbike desk and exercise semi-recumbent bicycle to be constructed with crossing frame members where the seat and pedals extend from one arm/leg and the display and rear support extends from the other arm/leg. The two arm/legs cross through a central pivot that allows the bicycle to be folded for easier transportation and storage. The legs, or cross supporting leg, can include one or more wheels that allows the Xbike to be rolled to a desired location.

It is still another object of the Xbike desk and exercise semi-recumbent bicycle for the person seated on the bicycle to exercise while they are seated. This allows a person to perform two separate activities. The amount of resistance can be adjusted to increase or decrease the difficulty to accommodate different levels of activity. The resistance can be from a variety of different mechanisms and can be manually adjusted or automatically adjusted. A recording or display mechanism can count distance, elapsed time, calories or other information.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
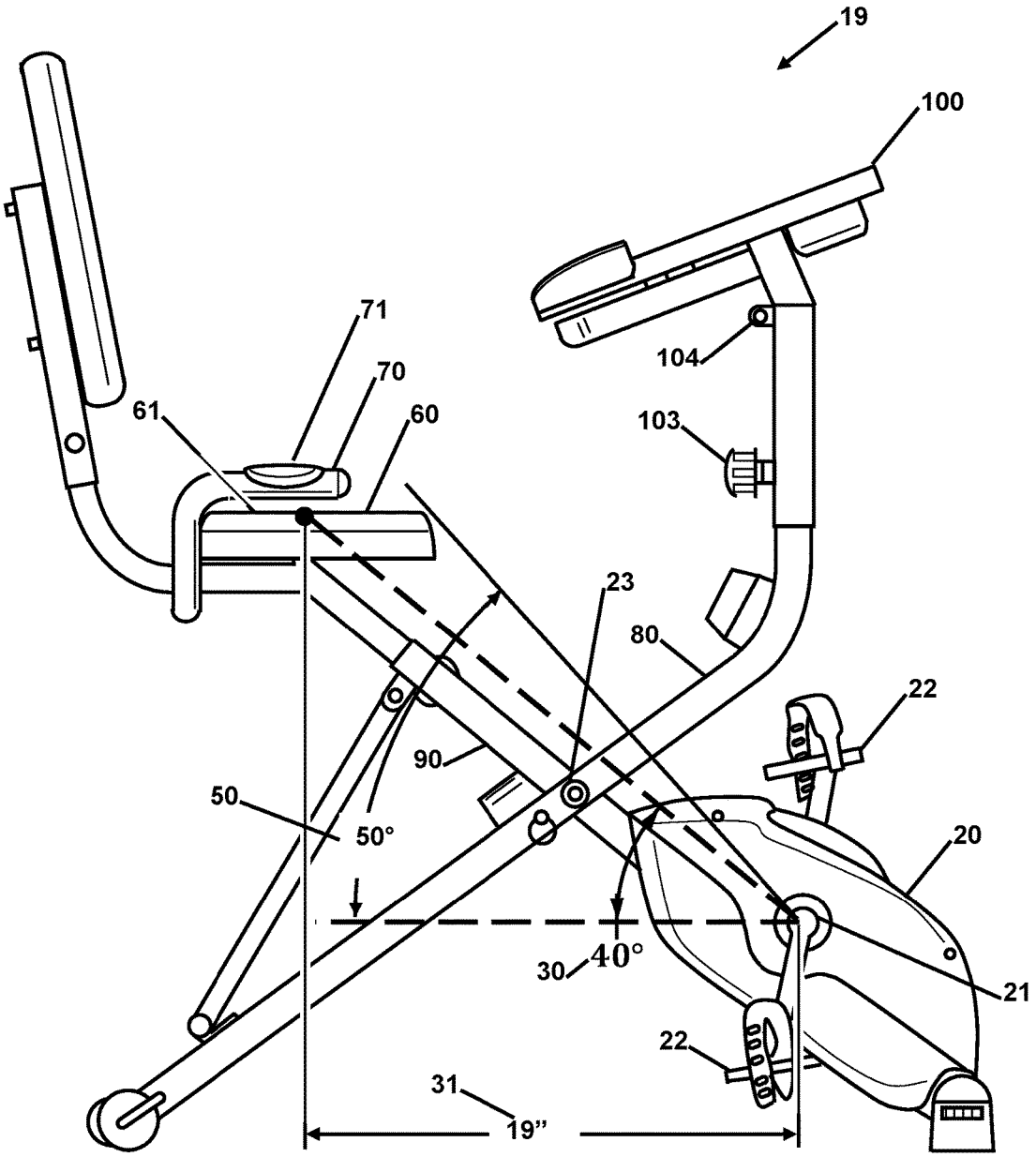
FIG. 1 shows an Xbike desk/exercise semi-recumbent bicycle.

FIG. 1 shows an Xbike desk/exercise semi-recumbent bicycle 19 with the angles showing the preferred orientation of the components. In this figure, the crank 21 is shown entering into the resistance housing 20. The resistance housing 20 provides the resistance that impedes rotation of the pedals 22 that turn the crank 21. Because the person exercising on the bicycle 19 is dependent upon the pedals 22, all of the geometry for the bicycle 19 is relative to the rotational axle of the crank 21. There are adjustments on the frame that allows for personalization of the crank 21 seat 60 to desk 100 for the comfort of a person using the Xbike to study and exercise as well as allowing a person to easily mount and dismount the Xbike.

The frame and seat are located in angular relationships to the crank 21. From the crank 21 to one leg/arm of the bicycle 19 is at an angle 30 of 40 degrees but other angles as low as 20 degrees are contemplated. Angles of less 40 degrees places a person in a more recumbent position and makes standing more difficult and also places the person further from the desk 100.

The angle 50 from the crank 21 to the front edge of the seat 60 is set at 50 degrees but other angles are contemplated. This provides a semi-recumbent bicycle 19 that allows an exerciser to essentially sit-up while they exercise without leaning forward or sitting with their feet in an elevated position that can be uncomfortable. These dimensions and angles are given as preferred embodiments, but other dimensions are contemplated to accommodate a user.

The distance from the crank 21 to the center of the seat pad 61 position of the person exercising is shown as 19 inches 31 as the shortest length. This embodiment further includes side hand grips 70 with heart rate sensors 71 or contact. From this side view, the X frame is visible as two leg/arm components 80 and 90 that cross though a central axis/axle 23. The crossed frame members allow the Xbike to be folded to make a smaller footprint for storage when it is not being used. The basic X frame is shown and describe in the following figure.

Figure 2:
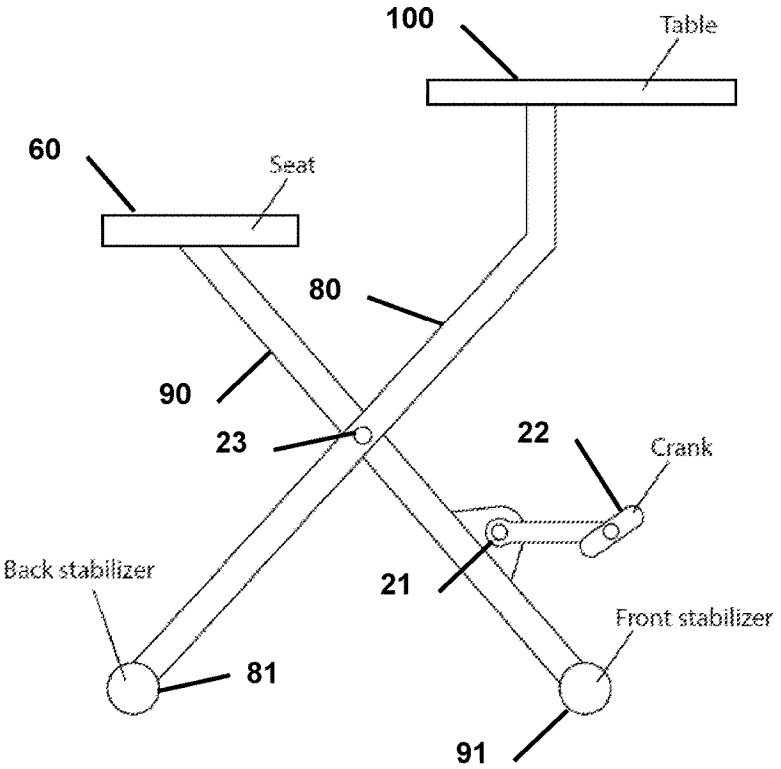
FIG. 2 shows a simplified side view of the basic Xbike frame.

FIG. 2 shows a simplified side view of the basic Xbike 19 frame. The housing for the loading system on the pedals 22 has been removed for simplicity in this figure. The X portion of the frame is easily seen with cross member 80 and 90 crossing through cross point pivot 23. The cross member 80 and 90 are configured to fold through the pivot 23 for easier storage and transportation. Fixed feet or rollers 81 and 91 are connected to cross members secured to the ends of X members 80 and 90 respectively.

The pivoting axle 21 is placed on member 90 and at a location above member 90 to reduce interference when folding the legs/arms 80 and 90. A seat or chair 60 is placed on the end of arm/leg 90 and a desk 100 is placed on the other arm/leg 80. This configuration leaves a fairly open region between the seat/chair 60 had the desk 100 for a person to stand between the pedals and the desk. This further allows a person to rest their feet on the ground or on one or more pedals 22.

Figure 3:
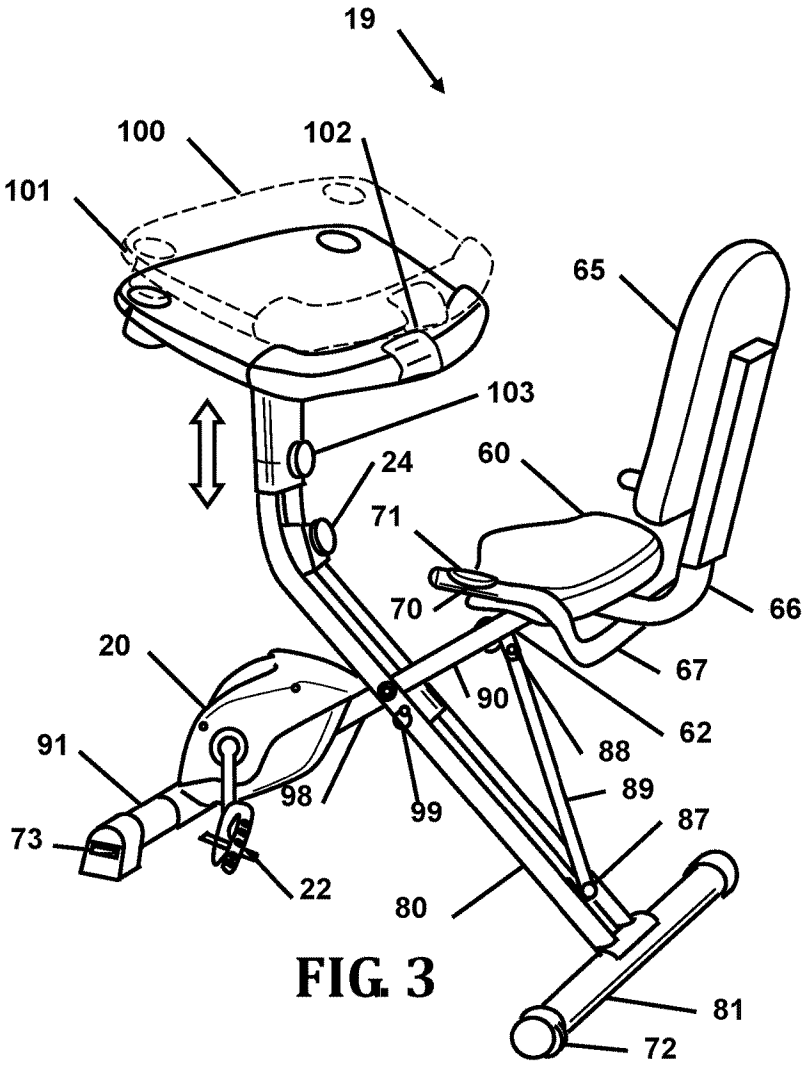
FIG. 3 shows a perspective view of the Xbike with the adjustable components.

FIG. 3 shows a perspective view of the Xbike 19 with the adjustable components. The perspective view shows the leg/arm 90 crossing through the split pieces 80. The horizontal legs 81 and 91 are shown secured to legs/arms 80, 90 respectively. A brace 89 is secured between leg/arm 80 at point 87 and leg/arm 90 at point 88. The brace 89 can be disconnected to collapse or fold the legs/arms 80, 90. The pedals 22 are shown connected to the axle and entering housing 20. The leg 81 has a wheel 72 to allow the Xbike to be rocked onto the wheel for easier transportation. The wheel is elevated when the Xbike is being used to prevent the Xbike from rolling to a different location when the Xbike is being used. Other legs 91 can have a height or leveling adjusting device 73 to account for variations in a floor surface.

A knob 24 or other control mechanism adjust the load/resistance on the pedals 22. This allows a person to perform two separate activities. The amount of resistance can be adjusted to increase or decrease the difficulty to accommodate different levels of activity. The resistance can be from a variety of different mechanisms including, but not limited to a frictional, a prony brake, magnetic, a fan, an alternator or a generator. A recording mechanism can count distance, elapsed time, calories or other information and can be displayed on a display 102 shown integrated into the desk 100, but can be separate from the desk 100.

The desk 100 is shown with cup holders 101, but the cup holders may be optional and/or the desk can include other items elements, including, but not limited to, a radio, TV, phone, USB port, charger, phone charger, outlet, camera and a portable device charger. The desk can be adjusted for elevation using knob 103 or can be adjusted for an angle and/or can be movable towards or away on track 106 from the seat 60. The desk has a 3 way adjustment with a pivot 104 that allows the angle of the desk to be quickly and easily adjusted to alter the angle, height and towards or away position of the desk to allow a person to easily enter and exit the seat of the Xbike.

The seat 60 is shown with side-mounted grips 70 that have a heart rate monitor 71. The heart rate monitor communicated with the display 102 to identify the heart rate. It is also contemplated that the resistance from the loading system in the housing 20 can be automatically controlled based upon the heart rate of the user. The seat 60 is shown with a back rest 65 supported on member(s) 66. The seat has an adjustment mechanism 62 that allows the seat or chair 60 to move on the arm/leg 90. The seat or chair 60 can be moved towards and away from the pedals 22 and the desk 100 for the comfort of the person exercising or using the desk 100 or for a person exercising as they use the desk 100.

Figure 4:
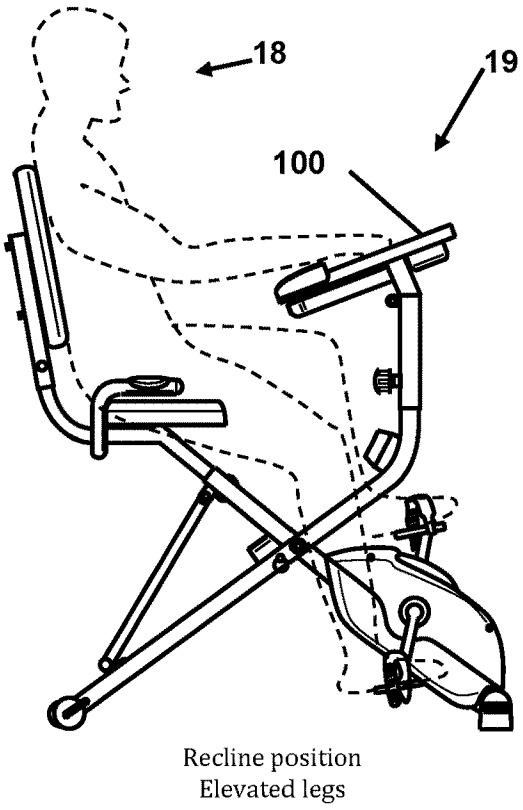
FIG. 4 shows a person on the Xbike in a semi-recumbent seated position.

FIG. 4 shows a person 18 on the Xbike in a semi-recumbent seated position with their feet on the pedals. From this view the person 18 is shown in a comfortable position where they can both exercise and use a computer on the desk 100 at the same time.

Figure 5:
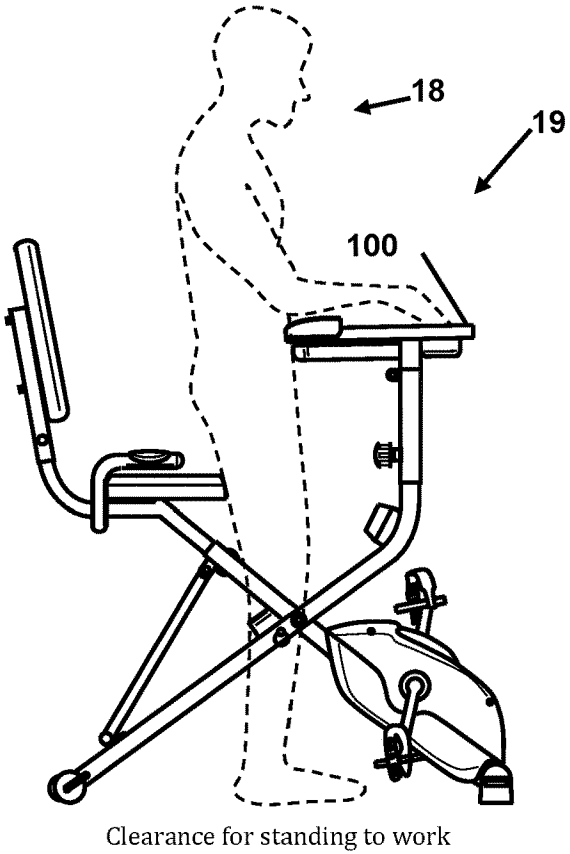
FIG. 5 shows a person standing between the seat and the desk/pedals.

FIG. 5 shows a person 18 standing between the seat and the desk with the pedals being clear of the standing position. This allows the person 18 to comfortably stand and operate the computer on the desk 100. The desk 100 has been slightly articulated to accommodate the erect orientation of the person. There is sufficient clearance between the seat and the pedals and the resistance housing as the person 19 stands.

Figure 6:
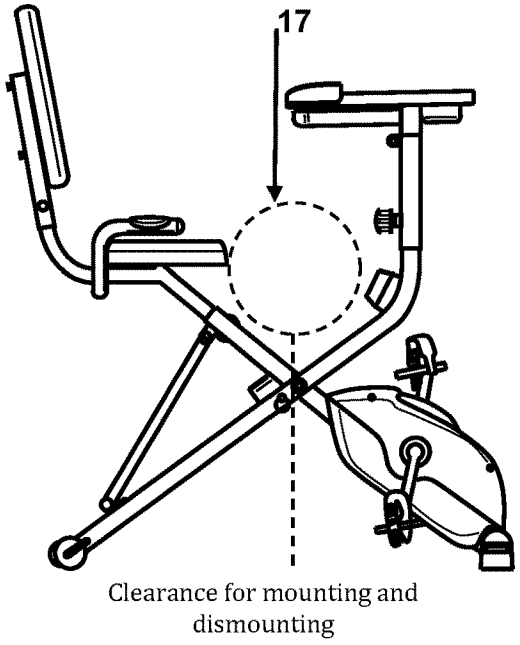
FIG. 6 shows the clearance for mounting and dismounting.

FIG. 6 shows the clearance 17 for mounting and dismounting the Xbike. The user can easily enter between the seat and pedals and desk. To use the desk and/or pedals to study read or perform other activities.

The Xbike is for a desk and exercise semi-recumbent bicycle that includes a foldable frame having at least two crossed components where the crossed components cross through a central pivoting axle. The foldable frame further has a pair of pedals on an axle connected to a resistance device on a first side of the first of the two crossed components. The seat or chair is mounted on a second side of the first of the two crossed components. There is a leg on a first side of the second crossed components, and there is a desk on a second side of the second crossed components.

The desk is adjustable relative to the pair of pedals. The seat or chair is adjustable relative to the pedals. The angle from the axle to a seat or chair is up to 40 degrees. The length from the axle to the seat or chair is 19 inches or less. The angle from the axle to a seat or chair is up to 40 degrees. The desk is independently adjustable for height relative to the seat or chair. The desk is independently adjustable at an angle to the seat or chair and the angle moves the desk closer and further from the seat or chair. The desk is independently adjustable toward and away from the seat or chair. The adjustments to the desk relative to the chair allows a user the ability to position the desk at a position that is optimal for using the desk to read, study or use a computer, tablet or phone while they exercise.

The desk can include, but is not limited to, having a radio, a cup holder, a TV, a phone, an USB port, a charger, a phone charger, a WiFi hub, a Bluetooth interface, an outlet, a light, a camera and a portable device charger.

The desk and exercise semi-recumbent bicycle according to further includes an adjustment mechanism that alter a resistance to the pair of pedals. The resistance can be manually or automatically adjustable. The resistance mechanism can be a variety of forms or mechanism including, but not limited to a frictional mechanism, a prony brake, a fan, magnetic, an alternator, eddy current, a generator and other resistance types that provide resistance to rotation of the pedals to provide resistance to the user to allow the user to exercise.

The desk and exercise semi-recumbent bicycle can include at least one handle with a heart rate monitor contact. The Xbike can have a wireless heart rate monitor. The resistance mechanism can automatically control the resistance mechanism connected to the pair of pedals to control a reading from the heart rate monitor.

The Xbike can include a display the is integrated in the desk or can be separate from the desk. The display can show a variety of items, including but not limited to distance, elapsed time, calories, heart rate, speed and time or day or elapsed time.

Thus, specific embodiments of a desk and exercise semi-recumbent bicycle have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. A desk and exercise semi-recumbent bicycle comprising:

a foldable frame having two crossed frame components where said two crossed frame components cross through a central pivoting axle;

said foldable frame further having a pair of pedals on an axle connected to a load/resistance to turning said pair of pedals on a first side of a first of said two crossed frame components;

a seat or chair mounted on a second side of said first of said two crossed frame components;

a leg on a first side of a second of said two crossed frame components;

a disconnectable brace secured under said seat or chair, between said second side of said first of said two crossed frame components to said first side of said second of said two crossed frame components;

a desk on a second side of said second of said two crossed frame components;

said desk is adjustable relative to said second of said two crossed frame components, such that said desk is configured to have three adjustments relative to said second side of said second of said two crossed frame components;

said three adjustments comprising a vertical adjustment of said desk on said second of said two crossed frame components, an angular adjustment of said desk relative to said second of said two crossed frame components and a horizontal forward and back of said desk relative to said second of said two crossed frame components, and a manual adjustment mechanism that operates to manually adjust the load/resistance on said pair of pedals, and a heart rate control mechanism that adjusts the load/resistance on said pair of pedals automatically based upon a heart rate reading from a heart rate monitor.

2. The desk and exercise semi-recumbent bicycle according to claim 1, wherein said desk is adjustable relative to said pair of pedals.

3. The desk and exercise semi-recumbent bicycle according to claim 1, wherein said seat or chair is adjustable relative to said pair of pedals.

4. The desk and exercise semi-recumbent bicycle according to claim 1, wherein an angle from said axle of said pair of pedals to said seat or chair is up to 40 degrees.

5. The desk and exercise semi-recumbent bicycle according to claim 1, wherein a length from said axle of said pair of pedals to said seat or chair is 19 inches or less.

6. The desk and exercise semi-recumbent bicycle according to claim 5, wherein an angle from said axle of said pair of pedals to said seat or chair is up to 40 degrees.

7. The desk and exercise semi-recumbent bicycle according to claim 1, wherein said desk is independently adjustable at an angle to said seat or chair on said second of said two crossed frame components.

8. The desk and exercise semi-recumbent bicycle according to claim 7, wherein a change of said angle corresponds to a change in the distance from said desk to said seat or chair.

9. The desk and exercise semi-recumbent bicycle according to claim 1, wherein said desk is independently adjustable toward and away from said seat or chair.

10. The desk and exercise semi-recumbent bicycle according to claim 1, wherein said desk includes at least one of a group comprising of a radio, a TV, a phone, an USB port, a charger, a phone charger, a WiFi hub, a Bluetooth interface, an outlet, a light, a camera and a portable device charger.

11. The desk and exercise semi-recumbent bicycle according according to claim 1, wherein said load/resistance to turning said pedals is selected from a group comprising of a frictional brake, a prony brake, an alternator, a fan, a magnetic brake, eddy current brake and a generator.

12. The desk and exercise semi-recumbent bicycle according to claim 1, wherein said desk and exercise semi-recumbent bicycle includes at least one handle with a heart rate monitor contact.

13. The desk and exercise semi-recumbent bicycle according to claim 1, further includes a display.

14. The desk and exercise semi-recumbent bicycle according to claim 13, wherein said display displays a group of items comprising of distance, elapsed time, calories, heart rate, speed and time.

15. The desk and exercise semi-recumbent bicycle according to claim 1, wherein said leg has at least one wheel.

16. A desk and exercise semi-recumbent bicycle comprising:

a foldable frame having two crossed frame components where said two crossed frame components cross through a central pivoting axle;

said foldable frame further having a pair of pedals on an axle connected to a load/resistance to turning said pair of pedals on a first side of a first of said two crossed frame components;

a seat or chair mounted on a second side of said first of said two crossed frame components;

a disconnectable brace secured under said seat or chair, between said second side of said first of said two crossed frame components to a first side of a second of said two crossed frame components;

a leg on said first side of said second of said two crossed frame components;

a desk on a second side of said second of said two crossed frame components;

said desk is adjustable relative to said second of said two crossed frame components, such that said desk is configured to have three adjustments relative to said second side of said second of said two crossed frame components;

said three adjustments comprising a vertical adjustment of said desk on said second of said two crossed frame components, an angular adjustment of said desk relative to said second of said two crossed frame components and a horizontal forward and back of said desk relative to said second of said two crossed frame components;

a heart rate monitor wherein said desk and exercise semi-recumbent bicycle adjusts and controls said load/resistance to turning said pair of pedals to control a reading from said heart rate monitor.

17. The desk and exercise semi-recumbent bicycle according to claim 16, wherein said seat or chair is adjustable relative to said pair of pedals.

18. The desk and exercise semi-recumbent bicycle according to claim 16, further includes a display.

19. The desk and exercise semi-recumbent bicycle according to claim 16, wherein an angle from said axle of said pair of pedals to said seat or chair is up to 40 degrees.

20. The desk and exercise semi-recumbent bicycle according to claim 16, wherein a length from said axle of said pair of pedals to said seat or chair is 19 inches or less.

* * * * *